United States Patent [19]

Bolduc

[11] 3,965,569

[45] June 29, 1976

[54] CUTTING APPARATUS

[76] Inventor: Lee R. Bolduc, 4624 W. 28th St., Minneapolis, Minn. 55416

[22] Filed: Aug. 18, 1975

[21] Appl. No.: 607,204

Related U.S. Application Data

[63] Continuation of Ser. No. 498,313, Aug. 19, 1974, abandoned.

[52] U.S. Cl. ..... 30/29.5; 30/43.6

[51] Int. Cl.[2] ..... B26B 19/14

[58] Field of Search ..... 30/29.5, 43.6, 205, 30/206, 207

[56] References Cited

UNITED STATES PATENTS

| | | | |
|---|---|---|---|
| 1,262,536 | 4/1918 | Martin | 30/43.6 X |
| 2,269,875 | 1/1942 | Huntington | 30/43.6 |
| 2,375,521 | 5/1945 | Boyd | 30/43.6 X |
| 3,054,179 | 9/1962 | Reiser | 30/29.5 |

*Primary Examiner*—Al Lawrence Smith
*Assistant Examiner*—Gary L. Smith
*Attorney, Agent, or Firm*—Burd, Braddock & Bartz

[57] ABSTRACT

A hair cutting apparatus having a body carrying an electric motor operable to drive a cutter head. The cutter head has an elongated sleeve member having a plurality of longitudinally directed teeth around its forward open end forming an annular comb. A pair of blades mounted on a shaft rotated by the motor engage the inside surface of the teeth. Springs bias the blades into engagement with the teeth whereby the circular movement of the blades cuts hair extended between adjacent teeth.

10 Claims, 7 Drawing Figures

FIG. 1
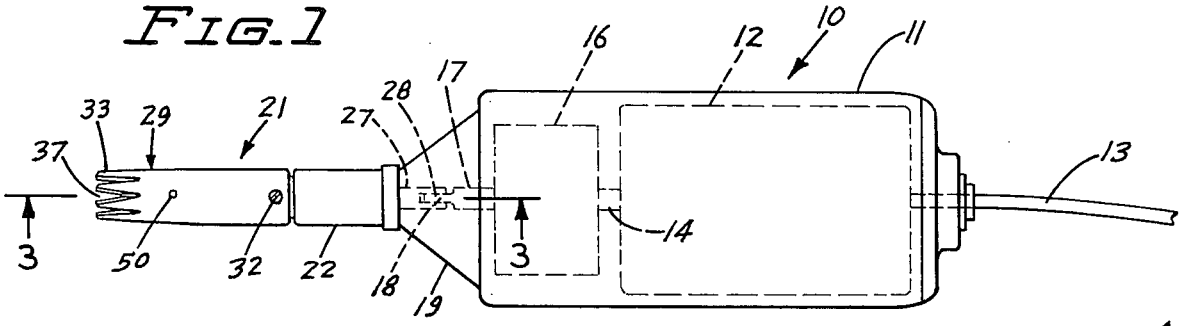
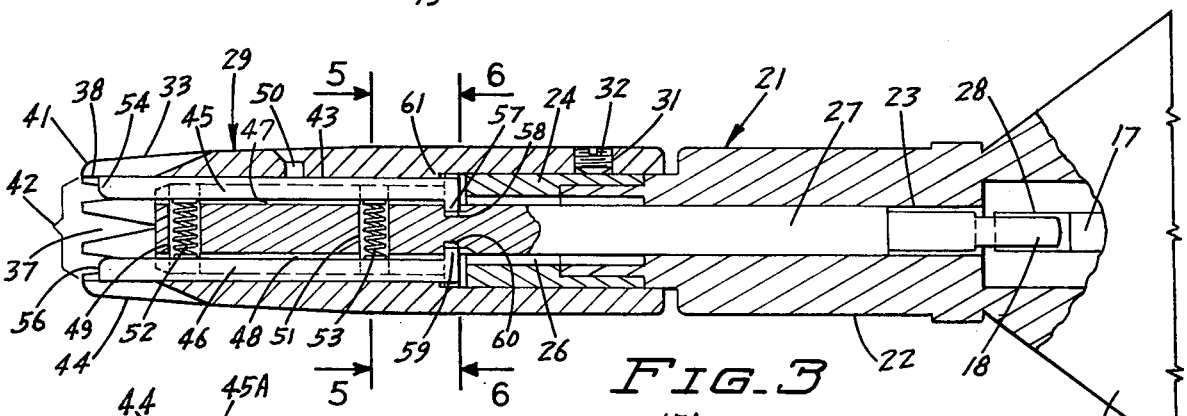
FIG. 3
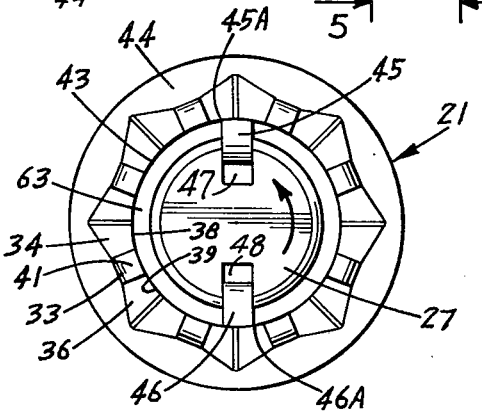
FIG. 4
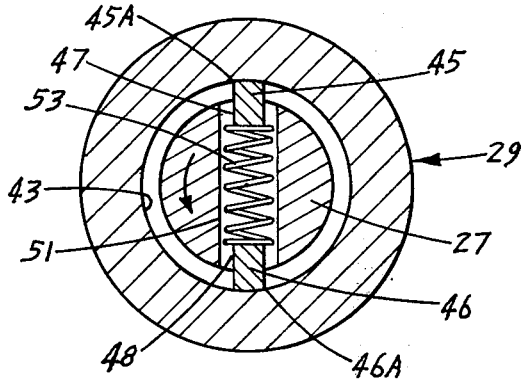
FIG. 5
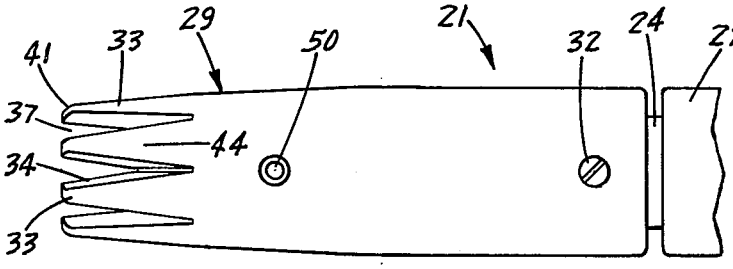
FIG. 2
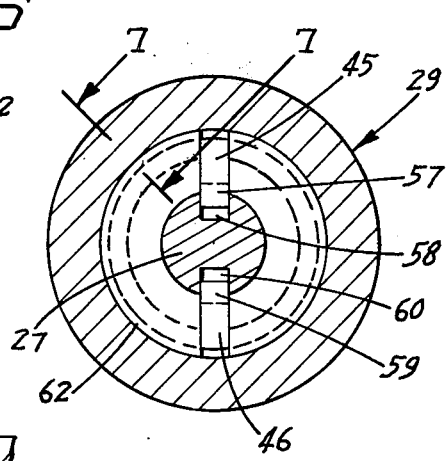
FIG. 6
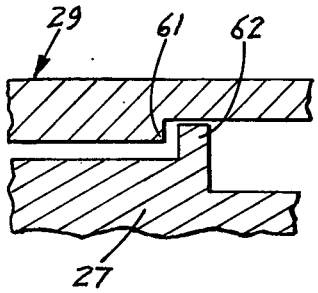
FIG. 7

CUTTING APPARATUS

This application is a continuation of application Ser. No. 498,313, filed Aug. 19, 1974 and now abandoned.

BACKGROUND OF INVENTION

Electric shavers and cutting devices are used to trim and cut body hairs growing in and around body cavities as the nose, ears and the like. Hand tools as scissors are also used to trim and cut body hairs in the vicinity of the body cavities. The skin tissue adjacent the body cavities is extremely delicate and care must be taken in the trimming of the hairs to prevent injury in the cutting operation. Nostril and ear hairs are not normally straight and exit from the skin at different angles. The hairs also grow to varying lengths and tend to locate adjacent to the skin. The prior art cutting devices are not designed to effectively accommodate the hairs of body cavities. These devices are too selective in their operation and pull a certain amount of hairs from their roots thereby irritating the skin tissue and causing pain. Examples of devices for cutting body hairs growing in adjacent body cavities are shown in U.S. Pat. Nos. 2,946,121; 3,381,373; and 3,731,379.

SUMMARY OF INVENTION

The invention is directed to an apparatus for cutting and trimming elongated filament like material located in or adjacent to a cavity or orifice. More particularly the apparatus of the invention is a hair cutting apparatus useful to cut the nostril and ear hairs of man and animal. The apparatus has a hand holding housing accommodating motor means for driving a cutter head. The cutter head has an elongated stationery cylindrical sleeve member. The sleeve member has an open forward end surrounded with a plurality of longitudinal outwardly directed teeth. Rotatable means having a plurality of cutting blades is located within the sleeve member. The motor means is operable to drive the rotatable means to move the blades in a circular path inside the sleeve. Biasing means acting on the blades yieldably urge the blades into engagement with the inside cylindrical surface of the sleeve member and teeth whereby the blades and side edges of the teeth operate to cut hairs which are located between adjacent teeth.

An object of the invention is to provide a hair cutting apparatus operable to pick up and cut or trim hairs growing in or adjacent to body cavities as the ear or nose without causing injury to the skin tissue. Another object of the invention is to provide a hair cutting apparatus with a cutter head that has a plurality of longitudinal cutting blades that are self-sharpening in use and are biased into engagement with a cylindrical surface having cutting edges. A further object of the invention is to provide a hair cutting apparatus with a cylindrical comb structure operable to pick up hair and divert the hair into cutting relationship with moving cutting blades. Another object of the invention is to provide a hair cutting apparatus with a cutter head having an open end surrounded by teeth which is self-cleaning in operation, relatively simple in construction, inexpensive to manufacture, and can be safely self-operated. The foregoing objects and other features and advantages of the cutting apparatus will be readily apparent when considered in view of the drawings and the following specifications.

IN THE DRAWINGS

FIG. 1 is a side elevational view of the hair cutting apparatus of the invention;

FIG. 2 is an enlarged side view of the hair cutting head of the apparatus of FIG. 1;

FIG. 3 is an enlarged sectional view taken along line 3—3 of FIG. 1;

FIG. 4 is an enlarged forward end view of the cutting head;

FIG. 5 is an enlarged sectional view taken along line 5—5 of FIG. 3;

FIG. 6 is an enlarged sectional view taken along line 6—6 of FIG. 3; and

FIG. 7 is a sectional view taken along line 7—7 of FIG. 6.

DESCRIPTION OF PREFERRED EMBODIMENT

Referring to FIG. 1, there is shown hair cutting apparatus of the invention indicated generally at 10 for cutting and removing hair from various body cavities as the nose and ear cavities. Hair cutting apparatus 10 has an elongated cylindrical housing or casing 11 enclosing an electric motor 12. A conventional power cord 13 is connected to the motor. Suitable switches (not shown) are used to turn the electric power on and off to the motor 12. Motor 12 can be a battery operated electric motor, a fluid driven motor or similar power generating means. Motor 12 has an output shaft 14 coupled to a power transmission 16. Power transmission 16 has a drive shaft 17 provided with a flat drive end 18. The power transmission 16 can be a planetary gear arrangement providing a speed reduction between shaft 14 and drive shaft 17. Other types of gear speed reducing drives can be used to transmit power from motor 12 to drive shaft 14.

A cone shaped neck 19 is attached to the end of housing 11 accommodating the drive shaft 17. An elongated generally cylindrical cutter head indicated generally at 21 mounted on the end of neck 19. Neck 19 has a cylindrical body 22 having a longitudinal passage 23. A sleeve 24 is mounted on the outer end of body 22. Sleeve 24 has a longitudinal passage 26 in axial alignment with the passage 23. An elongated rotating rod member or shaft 27 extends through the passages 23 and 26. Shaft 27 has a bifurcated end 28 that fits over the flat end 18 of the drive shaft 17 so that rotation of the drive shaft 17 will rotate the shaft 27.

A cap or sleeve member indicated generally at 29 is mounted on the collar 24. Member 29 has a hole 31 carrying a set screw 32. Set screw 32 engages the collar 24 to hold the member 29 on body 22. The outer end of member 29 has a plurality of longitudinal teeth 33 forming a circular comb. Teeth 33 have outwardly tapering configurations and side walls 34 and 36. A V-groove 37 is located between adjacent teeth. The teeth 33 have outwardly converging inside cutting edges 38 and 39 and a curved or rounded outer ends 41. The outer end of the member 29 is open as shown at 42 in FIG. 3 and in FIG. 4. Member 29 has eight teeth 33 circumferentially spaced around the circular inner cylindrical wall 43. The V-grooves 37 between adjacent teeth are identical in size and shape. The number of teeth can vary as well as the length and size of the teeth. Preferably, the teeth 33 have a length of 10 millimeters. The circular inner wall 43 has a diameter of 7 millimeters. The outside surface of the teeth 33 tapers or converges inwardly toward the nose ends 41 as shown in FIGS. 2, 3, and 4.

Referring to FIGS. 3 to 6, a pair of elongated linear cutting blades 45 and 46 are located within the member 29. Shaft 27 has a first linear groove 47 accommodating the blade 45. A second linear groove 48 located diametrically opposite the first groove 47 accommodates the blade 46. A pair of axially spaced transverse bores 49 and 51 are open to the grooves 47 and 48. A coil compression spring 52 is located in bore 49. A similar coil spring 53 is located in bore 51. The springs 52 and 53 engage the blades 45 and 46 and bias them outwardly into engagement with the circular cylindrical wall 43 and inside surfaces of the teeth. The blades 45 and 46 are elongated rectangular metal members having outer ends 54 and 56 respectively spaced inwardly from the nose ends 41 of the teeth 33 so that they will not cut or engage the tissue and membranes of the body cavities. The blades 45 and 46 having generally rectangular cross sectional configurations, as shown in FIG. 5, and cutting edges 45A and 46A along their leading sides. The edges 45A and 46A cooperate with the inner edges 38 of the teeth to cut hairs which extend between adjacent teeth 33. The blades 45 and 46 can be removed and reversed so that the opposite edges can be used as cutting edges. The springs 52 and 53 bias the blades 45 and 46 outwardly in opposite directions with substantially equal force. The frictional engagement of the blade 45 and 46 with circular inner wall 43 will self sharpen the blades as they move relative to the wall 43. The member 29 has a hole 50 which is used to apply lubricant, as oil, to the inside of the member 29 to reduce the friction of the blades 45 and 46 on the circular inner wall 43.

The inner ends of blades 45 and 46 have radially inwardly directed projections 57 and 59 respectively. Projection 57 extends into a recess 58 in shaft 27. In a similar manner projection 59 extends into a recess 60 in the shaft 27. The projections 57 and 59 limit the longitudinal movement of the blades 45 and 46 relative to the shaft 27 so that the blades 45 and 46 cannot escape through the open end 42 of the member 29.

As shown in FIG. 7, the shaft 27 has an annular outwardly directed rib 62. Rib 62 located adjacent to an inwardly directed annular shoulder 61 on the member 29 prevents the shaft 27 from moving longitudinally out of the open end 42. The shoulder 61 and rib 62 also hold the shaft 27 in driving engagement with the drive shaft 17.

In use, when the motor 12 is energized it drives the power transmission 16. The drive shaft 17 of the power transmission 16 rotates the cutter shaft 27. The blades 45 and 46 being located in the longitudinal grooves 47 and 48 rotate with the shaft 27. The springs 52 and 53 bias the blades 45 and 46 radially outwardly into engagement with the circular cylindrical wall 43.

The teeth 33 function as a circular comb to pick up and guide the hair into the V-shaped grooves 37. The hair that extends into the space 63 surrounded by the teeth 33 are cut with the blades 45 and 46. The blades 45 and 46 being recessed below the rounded nose portions 41 of the teeth 33 do not engage or cut the tissue carrying the hairs. The outer edges of the teeth 33 are rounded so that they do not cut grooves or damage the body tissues. The blades 45 and 46 moving around in the space 63 are self cleaning as the end of member 29 is open. The grooves 37 between the adjacent teeth 33 can be readily cleaned with a brush or similar bristle implement.

While there has been shown and described preferred embodiment of the invention of the hair cutting apparatus of the invention it is understood that changes, substitutions of parts, size and proportions of the parts may be made by those skilled in the art without departing from the invention. The motor 12 can be replaced with a battery operated motor or equipped with a component which permits both AC and DC operation of the motor. The drive shaft 14 of motor 12 can be connected directly to the rotatable shaft 27 when a slow speed motor is used. Motor 12 can be replaced with a spring actuated drive mechanism. The spring can be wound with a key or crank device. Alternatively, the spring can be energized with a lever mechanism. A lever mechanism can be used to directly drive the transmission and thereby rotate the shaft 27.

I claim:

1. An apparatus for cutting hair comprising: a housing, an elongated generally cylindrical cutter means mounted on the housing operable to cut hair, said cutter means having a sleeve member with an open forward end, a plurality of forwardly directed teeth located around the open forward end, and a cylindrical inside wall surrounding a passage open to the forward end, adjacent teeth being spaced from each other to provide a plurality of separate V-grooves for accommodating hair, each of said grooves having an inner end and an open end whereby hair can move through the open outer end into the grooves between adjacent teeth, blade means located in the passage, said blade means comprising a pair of elongated bar members, each bar member having an elongated outer surface extended along the length of the bar member in surface engagement with the inside cylindrical wall, a linear cutting edge extended along one side of the outer surface, and generally flat sides, a rotatable member located in the passage, said rotatable member having an outer end located in general transverse alignment with the inner ends of the grooves in the sleeve member, said rotatable member having an outwardly directed annular rib, said cutter means having an inwardly directed annular shoulder cooperating with the rib to limit the longitudinal movement of the rotatable member, said rotatable member being a cylindrical member having two pairs of circumferentially spaced longitudinal walls forming a pair of longitudinal grooves located on diametrically opposite sides of the member, said bar members being located in said longitudinal grooves for rotation with the rotatable member, parts of the sides of said bar members being engageable with the longitudinal walls forming the longitudinal grooves, said bar members having outer end portions extended outwardly from the outer end of the rotatable member, said linear cutting edges of said end portions on rotation of the rotatable member cooperating with the teeth to cut the hair extended through the grooves in the sleeve member, means for biasing the blade means into engagement with the cylindrical inside wall, said means for biasing including a spring mounted on the rotatable member and engageable with the bar members, drive means connected to the rotatable member to move the blade means relative to the teeth to cut hair extended through the grooves in the sleeve member between adjacent teeth, and means engageable with the bar members and rotatable member to limit longitudinal movement of the bar members relative to the rotating member.

2. The apparatus of claim 1 wherein: the means to limit longitudinal movement of the bar members include recesses in the cylindrical member open to the longitudinal grooves, and each bar member has a projection extended into a recess.

3. The apparatus of claim 1 wherein: the cylindrical member has transverse bore means for accommodating the spring, said bore means being open to the longitudinal grooves.

4. The apparatus of claim 1 wherein: the means for biasing include a plurality of springs and the cylindrical member has a plurality of transverse bore means for accommodating the springs said bore means being open to said longitudinal grooves.

5. The apparatus of claim 1 wherein: said bar members have outer ends located inwardly from the outer ends of the teeth.

6. A cutting apparatus comprising: cutter means having a cylindrical member, said cylindrical member having a longitudinal passage, an open forward end, a plurality of forwardly directed teeth located around the passage, and an inside cylindrical wall located inwardly of the teeth, adjacent teeth being spaced from each other to provide a plurality of separate grooves for accommodating hair, each of said grooves having an inner end and an outer end whereby hair can move through the open outer end into the grooves between adjacent teeth, blade means located in the passage engageable with the teeth and cylindrical wall, a rotatable member located in the passage, said rotatable member having an outer end located in general transverse alignment with the inner ends of the grooves and an outwardly directed annular rib, said cylindrical member having an inwardly directed annular shoulder cooperating with the rib to limit longitudinal movement of the rotatable member, said blade means being mounted on the rotatable member for rotation with the rotatable member, said blade means having a plurality of linear bar members, each bar member having an end portion extended outwardly from the outer end of the rotatable member, each end portion being engageable with the inside surfaces of the teeth whereby on movement of the bar members relative to the teeth the end portions of the bar members will cut hair extended between adjacent teeth, said rotatable member having a plurality of outwardly open longitudinal grooves, a linear bar being located in each groove, means engageable with the bar members and rotatable member to limit longitudinal movement of the bar members relative to the rotatable member, means carried on the rotatable member for biasing the bar members into engagement with the inside surfaces of the teeth and cylindrical wall, and drive means for rotating the rotatable means and thereby move the blade means relative to the teeth to cut hair extended through the grooves between adjacent teeth.

7. The apparatus of claim 6 wherein: the means to limit longitudinal movement of the bar members include recesses in the rotatable member open to the grooves and each bar member has a projection extended into a recess.

8. The apparatus of claim 6 wherein: the rotatable member has transverse bore means for accommodating the biasing means, said bore means being open to a pair of the grooves in the rotatable member.

9. The apparatus of claim 6 wherein: the rotatable member has a plurality of transverse bore means for accommodating the biasing means, said bore means being open to said grooves.

10. The apparatus of claim 6 wherein: said blade means have outer ends located inwardly from the outer ends of the teeth.

* * * * *